United States Patent [19]

Fisker

[11] 4,403,913

[45] Sep. 13, 1983

[54] GUIDE BLADE ARRANGEMENT FOR ADJUSTABLE GUIDE BLADES

[75] Inventor: Jens E. Fisker, Snekkersten, Denmark

[73] Assignee: Helsingoer Vaerft A/S, Elsinore, Denmark

[21] Appl. No.: 317,843

[22] Filed: Nov. 3, 1981

[51] Int. Cl.[3] ..... F04D 27/00

[52] U.S. Cl. ..... 415/150; 415/164; 415/211

[58] Field of Search ..... 415/150, 151, 211, 163, 415/164, 165, 148

[56] References Cited

U.S. PATENT DOCUMENTS 3,236,498 2/1966 Kerensky ..... 415/164 X 3,243,159 3/1966 Hefler et al. ..... 415/150 X

FOREIGN PATENT DOCUMENTS 123203 12/1926 Switzerland ..... 415/165

*Primary Examiner*—Philip R. Coe

*Assistant Examiner*—Joseph M. Pitko

*Attorney, Agent, or Firm*—Ernest F. Marmorek

[57] ABSTRACT

A guide blade arrangement for devices for flowing medium and comprising an annular passage (20) wherein a ring of angularly adjustable guide blades (22) are arranged. Said passage is provided with an inner wall (26) separating it from a control chamber (28). Each guide blade (22) is provided with a supporting pin (36) rotatably mounted in said inner wall extending through the same and provided within said control chamber with an arm (40), the free end of which is by means of a stud (42) pivotably connected to a control member (45) common to all said arms. All said arms (40) being parallel and having the same length and said control member being constituted by a control ring (45) carried by said studs (42), whereby special supporting means for the said ring within the control chamber are avoided. Said control ring (45) being connected to an adjusting member (60) operatable from outside said control chamber, by means of which the control ring (45) can be given a translatory displacement ensuring a simultaneous and uniform angular pivoting of said arms (40) and, thereby, of all said guide blades (22).

3 Claims, 2 Drawing Figures

GUIDE BLADE ARRANGEMENT FOR ADJUSTABLE GUIDE BLADES

TECHNICAL FIELD OF THE INVENTION

This invention relates to a guide blade arrangement for devices for flowing mediums, preferably for a bladed diffusor of a compressor, which device comprises an annular passage limited by an outer side wall and an inner side wall, a ring of angularly adjustable guide blades arranged within said passage, said inner side wall further limiting at the side thereof opposite to said passage an annular control chamber besides limited by an outer and an inner annular wall as well as by a back wall, each said guide blade being provided with a supporting pin that is rotatably mounted in said inner side wall extending through the same into said control chamber, said supporting pins having mutually parallel axes extending along a circular cylinder face, and each said supporting pin being provided within said control chamber with a side arm having a free end that is pivotably connected to a control member common to all said arms by means of a stud the axis of which is parallel to said supporting pin axes.

BACKGROUND OF THE INVENTION

Corresponding arrangements are known by which each supporting pin is provided inside said control chamber with a pinion engaging a gear rim of a control wheel rotatably mounted within said control chamber and rotatable by adjustment means outside said chamber. Such a device demands a very exact montage of each part involved since it is of uttermost importance that after each adjustment all the blades take up the same relative angular position. Further the outer means for the adjustment have to be arranged outside the backwall. Consequently, such an arrangement demands quite a lot of space.

Therefore, more commonly arrangements as the one first stated above are used. By the known arrangements of this type the arms on the supporting pins are nearly radial and their studs engage slots in an annular disc rotatably mounted within the control chamber and connected to adjustment means outside the chamber by which it can be given a limited rotation resulting in a uniform pivoting of all arms and thereby all guide blades. In such an arrangement an exact uniform adjustment of the angular position of each guide blade mainly depends on the precision at the manufacture and is easier to ensure than by use of gears. Also such an arrangement demands, however, that the outer adjustment means are mounted at the outside of the backwall as well as special supporting means for the control member and, therefore, also such an arrangement demands relatively much space making it difficult to obtain space enough when the arrangement is to be used in more compact machinery such as multistage compressors and compressors combined with a gear device, where the impeller is arranged overhanging its driving shaft.

OBJECT OF THE INVENTION

The object of the present invention is to provide a guide blade arrangement of the type concerned which is uttermost simple and nevertheless is able to ensure a very uniform adjustment of the guide blades, takes up only very little space and may be operated from the outside of the outer annular wall of the control chamber so that there is no demand for special space between the outside of the backwall of the control chamber and a neighbouring machinery part.

SUMMARY OF THE INVENTION

According to the invention this is obtained by all arms of the supporting pins being mutually parallel and having the same length, and by the common control member being constituted by a control ring with which the studs are rotatably connected and which by means of these studs is carried by said arms, whereby said control ring is connected to an adjustment member adapted to provide a translatory displacement of the control ring.

By such an arrangement no space demanding supporting means for the control member are necessary within the control chamber, and when by means of the adjacent member the control ring is displaced, preferably in a direction approximately perpendicular to the arms, it is given a pure translatory movement by which each point thereof is following a circular arch the radius of which is parallel to the arms and have the same length as these. Further, by such a translatory displacement of the control ring all the arms and thereby all the guide blades are forced to be pivoted through exact the same angle.

Still further, considering the relatively small angular range through which the blades have to be adjusted, the said translatory displacement is very similar to a rectlinear displacement and, therefore, the adjustment of the control ring may be provided by adjustment means extending into the control chamber through the outer annular wall thereof so that even the adjustment means takes up no space outside the backwall of the control chamber.

Hereby a further advantage can be obtained, namely in case the adjustment means comprises a rod like portion that is by means of a stuffing box slideably mounted in said outer annular wall operatable from outside the annular wall but inside the same being connected to the control ring by means of a linkage. In this case, provided the walls of the control chamber are interconnected in an air tight manner, the control chamber may without disadvantages be allowed to take up the relative high pressure within the guide blade chamber, and, consequently no sealing devices are necessary for the blade supporting pins within the rear wall of the blade passage through which said pins extend into the control chamber.

DESCRIPTION OF AN PREFERRED EMBODIMENT OF THE INVENTION

Figure 1:
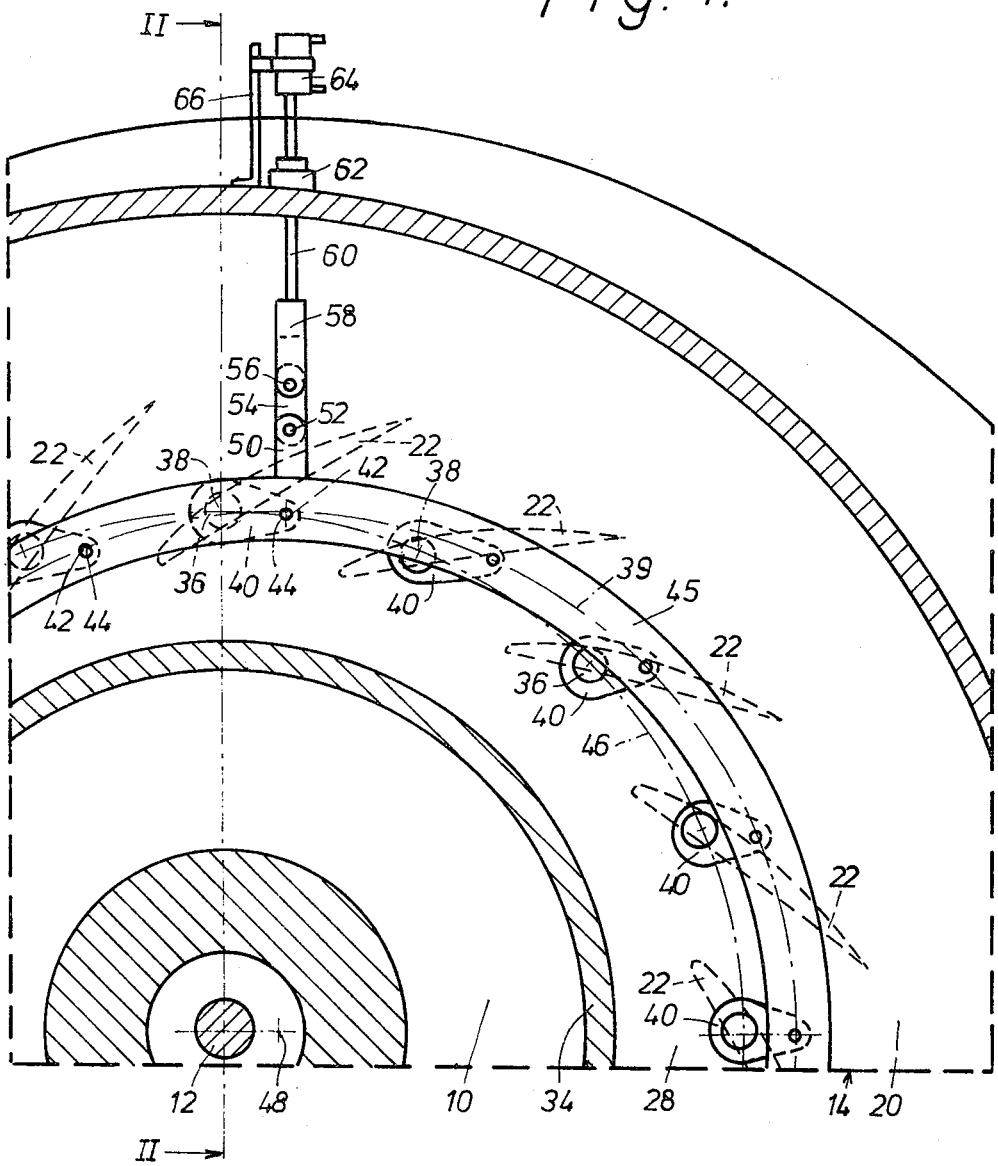
FIG. 1 is a partial cross sectional view, taken along the plane of lines I—I in FIG. 2, of a guide blade arrangement in a bladed diffusor portion of a compressor.
Figure 2:
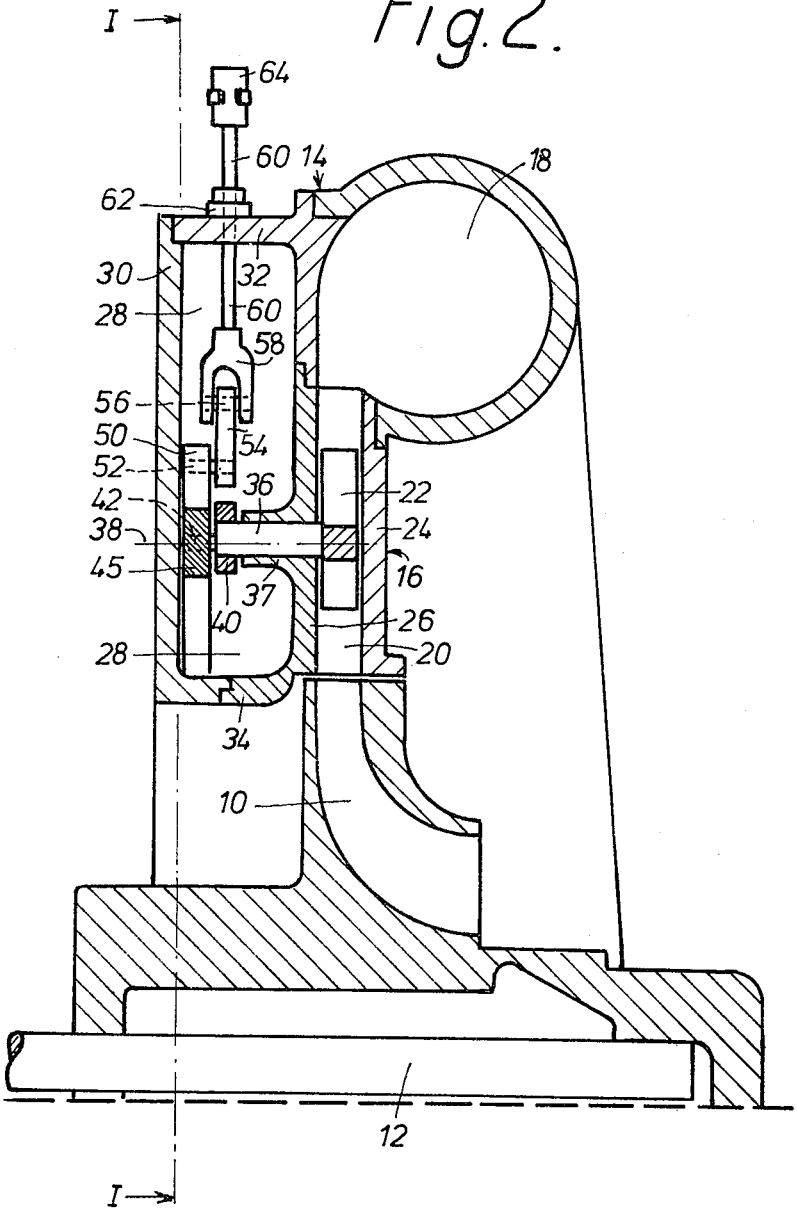
FIG. 2 is a partial axial sectional view taken along the plane of line II—II in FIG. 1.

Referring to the drawing FIGS. 1 and 2 show a compressor comprising an impeller 10 that in an overhanging manner is mounted on a driving shaft 12. The impeller 10 is blowing into a diffusor 14 comprising an annular blade diffusor portion 16 leading to a spiral-diffusor 18.

The bladed diffusor portion 16 comprises a passage 20 wherein the guide blades 22 of this diffusor portion are arranged. The passage 20 is limited by an outer side wall 24 and an inner side wall 26. This inner side wall 26 is also limiting an annular control chamber 28 at the outer side of the inner wall 26 and further limited by a back wall 30 opposite to the inner wall 26, an annular outer wall 32 and an annular inner wall 34. The walls 26, 30, 32 and 34 are in a manner not shown interconnected in such a manner that the connections between each two of these walls are airtight.

Each guide blade 22 is provided with a supporting pin 36 that is rotatably mounted in the inner side wall 26 extending through the same. The inner side wall 26 is at its rear side for each supporting pin 36 formed with a bushing 37 extending into the control chamber 28 and ensuring that each supporting pin 36 is rigidly supported by the side wall 26. The axes 38 of the pins 36 are parallel and extend along a theoretical circular cylinder face 46, FIG. 2, coaxial to the shaft 12.

Inside the control chamber 28 at the free ends of the bushings 37 each pin 36 is provided with an arm 40 that at its free end is provided with a stud 42, the axis 44 of which is parallel to the axes 38 of the pins 36. All the arms 40 are parallel, that is, the planes through the axes 38 and 44 of the arms are parallel. Further is the length of all the arms 40 measured as the distance between the appertaining axes 38 and 44 the same.

All the studs 42 are rotatably mounted in a common ring member or control ring 45 which thereby is carried by said studs 42 and which shows a theoretical circular cylinder face 39 through the axes 44 of the studs 42. This cylinder face has the same diameter as the above said circular cylinder face 37 but having its center axis 48 displaced from the axis of the shaft 12 a distance corresponding to the length of the arms 40 measured as stated above and in the direction of said arms.

Consequently, provided one of the guide blades 22 and thereby the corresponding arm 40 is pivoted a certain angle around its axis of rotation 38, the control ring 45 as a whole will be given such a translatory displacement, that each point of the ring 45 is moving along a circular arch having a radius equal to the length of the arms 40 and a fixed center that at each position is placed in the distance of said radius in a direction parallel to the arms away from the point. Consequently, in case the control ring is given such a translatory movement, all the blades 22 will turn simultaneously and through the same angle.

For providing such a translatory displacement of the control ring 45 the same is provided at a place where its radius is approximately perpendicular to an arm 40, when the blades 22 takes up a middle position between two possible end positions, with an upright 50 provided at its free end with a stud 52. This stud 52 is rotatably mounted at the inner end of a linkage 54, the outer end of which is by means of a stud 56 rotatably mounted in a yoke 58. This yoke 58 is fastened to the lower end of an adjustment rod 60 that axially displaceable extends through a stuffing box 62 in the annular outer wall 32. This adjustment rod 60 may outside the wall 62 be connected to per se known means by which it can be displaced in its axial direction for adjusting the position of the control ring 45 and, thereby, simultaneously the angular position of all the blades 22.

Thus, as shown, the adjustment rod 60 may at its upper end be connected to the piston of a hydraulic cylinder 64 supported by an upright 66 at the top of the annular wall 32 and in a manner not shown constituting a part of a hydraulic servo-system taking care of the adjustment of the guide blades 22, for example in dependency of the contents of oxygen in sewage aerated by means of the compressor.

I claim:

1. A guide blade arrangement for devices for flowing media for use in connection with controlling a stream of fluid and having an annular passage, limited by an outer wall and an inner wall, a ring of angularly adjustable guide blades being arranged within said passage, said inner wall further limiting on the side thereof opposite to said passage a control chamber further limited by an annular inner wall and an annular outer wall as well as by a back wall, each said guide blade being provided with a supporting pin that is rotatably mounted in said inner wall extending through the inner wall into said control chamber, said supporting pins having mutually substantially parallel axes extending along an annular curvature line, and each said supporting pin being provided within said control chamber with an arm having a free end that is pivotably connected to a control member common to all said arms by means of a stud having an axis that is substantially parallel to said supporting pin axes, wherein:

all said arms being mutually substantially parallel and having the same length measured as the distance between the axes of the corresponding one of said supporting pins and the corresponding one of said studs, and that said control member is constituted by a control ring that by means of said studs is carried by said arms, and which control ring is connected to an adjusting member adapted to provide a translatory displacement of said control ring and a first center point common to said annular curvature line and to said annular passage, and said control ring having a second center point being eccentric with respect to the first center point.

2. A guide blade arrangement according to claim 1 wherein said adjusting member is slidable and is connected to said control ring by means of a linkage, whereas said adjusting member is carried through said outer annular wall.

3. A guide blade, arrangement according to claim 2 wherein said adjusting member comprises a rod like member extending outwards from said control chamber through a stuffing box arranged in said outer annular wall.

* * * * *